US007568893B2

(12) United States Patent
Koyama

(10) Patent No.: US 7,568,893 B2
(45) Date of Patent: Aug. 4, 2009

(54) ELECTRIC AIR PUMP FOR SECONDARY AIR SUPPLY SYSTEM

(75) Inventor: Hiroyasu Koyama, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 923 days.

(21) Appl. No.: 11/100,375

(22) Filed: Apr. 7, 2005

(65) Prior Publication Data

US 2005/0244285 A1 Nov. 3, 2005

(30) Foreign Application Priority Data

Apr. 28, 2004 (JP) ..... 2004-133330

(51) Int. Cl.
*F04B 49/10* (2006.01)
*F04B 49/06* (2006.01)
*H01R 39/38* (2006.01)

(52) U.S. Cl. ..... 417/32; 417/44.2; 310/239; 310/68 R

(58) Field of Classification Search ..... 417/44.1, 417/44.11, 32, 44.2, 45; 310/686, 239, 68 R; 388/825, 909
See application file for complete search history.

(56) References Cited

U.S. PATENT DOCUMENTS 5,158,436 A * 10/1992 Jensen et al. ..... 417/32
5,168,415 A * 12/1992 Osuga ..... 361/28
5,838,591 A * 11/1998 Yamaguchi ..... 700/299
6,633,104 B1 * 10/2003 Hershey et al. ..... 310/242
7,107,762 B2 * 9/2006 Hirooka ..... 60/289
7,305,299 B2 * 12/2007 Yasui et al. ..... 701/109
2008/0278026 A1 * 11/2008 Kobayashi ..... 310/253

FOREIGN PATENT DOCUMENTS

| | | | |
|---|---|---|---|
| DE | 42 44 458 A1 | | 7/1993 |
| JP | A 02-303347 | | 12/1990 |
| JP | A 5-202889 | | 8/1993 |
| JP | A-7-26949 | | 1/1995 |
| JP | A-2003-14552 | | 1/2003 |
| JP | A 2003-83048 | | 3/2003 |
| JP | 2004100525 | * | 4/2004 |
| JP | A 2004-100525 | | 4/2004 |

* cited by examiner

*Primary Examiner*—Charles G Freay
(74) *Attorney, Agent, or Firm*—Oliff & Berridge, PLC

(57) ABSTRACT

When an air pump is operated, a brush temperature increase rate stored in an ECU in relation to a discharge pressure of the air pump and a brush temperature is multiplied by a calculation cycle time, and the resultant value is cumulatively added. When the air pump is stopped, a brush temperature decrease rate stored in the ECU in relation to the brush temperature is multiplied by the calculation cycle time, and the resultant value is cumulatively added. Each of the cumulative values read from a map is added to and subtracted from an initial brush temperature value, respectively so as to estimate the brush temperature.

16 Claims, 14 Drawing Sheets

(A)

(B)

(A)

(B)

100 ··· MOTOR

104 ··· COMMUTATOR

105 ··· BRUSH

ELECTRIC AIR PUMP FOR SECONDARY AIR SUPPLY SYSTEM

INCORPORATION BY REFERENCE

The disclosure of Japanese Patent Application No. 2004-133330 filed on Apr. 28, 2004, including the specification, drawings and abstract are incorporated herein by reference in its entirety.

BACKGROUND OF THE INVENTION

1. Field of Invention

The invention relates to an electric air pump employed for a secondary air supply system, and more particularly, to an electric air pump having a motor with a brush.

2. Description of Related Art

An electric air pump having a motor with a brush is generally employed in a secondary air supply system for purifying the exhaust gas. It is necessary to prevent excessive heating of the brush of the motor for the electric pump so as to avoid the failure in the pump operation caused by the excessive temperature rise in the brush. The publication of JP-A-5-202889 discloses the art for blowing air to the brush so as to be cooled.

In the art disclosed in the publication, the brush is blown by air, but the actual temperature of the brush cannot be estimated. It is difficult to determine whether the temperature of the brush has decreased to the temperature equal to or lower than an allowable value.

SUMMARY OF THE INVENTION

It is an object of the invention to accurately estimate a temperature of a brush of a motor for an electric air pump employed for a secondary air supply system.

An electric air pump that is driven by a motor with a brush and employed for a secondary air supply system is provided with a brush temperature change rate storage unit that stores a brush temperature change rate, and a brush temperature estimation unit that estimates a temperature of the brush based on the brush temperature change rate stored in the brush temperature change rate storage unit. In the electric air pump, the brush temperature change rate stored in the brush temperature change rate storage unit includes a brush temperature increase rate after a starting operation of the motor, which is stored in accordance with a discharge pressure of the electric air pump.

In the above structured electric air pump, the temperature of the brush is estimated based on a brush temperature increase rate during a motor operation, which is stored in accordance with a discharge pressure of the pump.

In the above-structured electric air pump, the brush temperature change rate stored in the brush temperature change rate storage unit includes a brush temperature decrease rate after a stopping operation of the motor.

In the above-structured electric air pump, the brush temperature estimation unit includes an initial brush temperature estimation unit that estimates an initial brush temperature.

In the above-structured electric air pump, the brush temperature estimation unit estimates the temperature of the brush by executing at least one of adding a value obtained by multiplying the brush temperature increase rate by a length of time to the initial brush temperature estimated by the initial brush temperature estimation unit, and subtracting a value obtained by multiplying the brush temperature decrease rate by a length of time from the initial brush temperature estimated by the initial brush temperature estimation unit.

In the above-structured electric air pump, the length of time multiplied by one of the brush temperature increase rate and the brush temperature decrease rate may be a calculation cycle, and the addition and the subtraction are cumulatively performed.

In the above-structured electric air pump, the length of time multiplied by the brush temperature increase rate may be a time elapsing from the starting operation of the air pump, and the length of time multiplied by the brush temperature decrease rate may be a time elapsing from stopping the operation of the air pump. The addition and the subtraction are cumulatively performed.

In the above-structured electric air pump, the brush temperature increase rate stored in the brush temperature change rate storage unit is set to become high as the discharge pressure of the air pump becomes high.

The above-structured electric air pump is provided with at least one of a brush temperature increase rate correction unit that corrects the brush temperature increase rate to become small as a difference between the brush temperature and an atmospheric temperature becomes large, and a brush temperature decrease rate correction unit that corrects the brush temperature decrease rate to become large as the difference between the brush temperature and the atmospheric temperature becomes large.

In the above-structured electric air pump, the brush temperature increase rate correction unit decreases the brush temperature increase rate as the time elapsing from the starting operation of the motor becomes long, and the brush temperature decrease rate correction unit decreases the brush temperature decrease rate as the time elapsing from stopping the motor operation becomes long.

The above-structured electric air pump is provided with an atmospheric temperature estimation unit that estimates the atmospheric temperature of the brush. In the electric air pump, at least one of the brush temperature increase rate and the brush temperature decrease rate is corrected based on the atmospheric temperature estimated by the atmospheric temperature estimation unit.

The above-structured electric air pump is provided with an atmospheric temperature estimation unit that estimates the atmospheric temperature of the brush. In the electric air pump, the initial brush temperature estimation unit estimates the brush temperature at the starting operation based on the atmospheric temperature estimated by the atmospheric temperature estimation unit.

In the above-structured electric air pump, the atmospheric temperature estimation unit estimates the atmospheric temperature based on an intake air temperature and a coolant temperature.

In the above-structured electric air pump, when the difference between the intake air temperature and the coolant temperature detected by the atmospheric temperature estimation unit is equal to or smaller than a predetermined value, the atmospheric temperature is set to the initial brush temperature.

In the above-structured electric air pump, a shut-off air pump pressure is detected as a discharge pressure obtained when an outlet of the air pump is shut off, and the brush temperature increase rate is corrected based on the detected shut-off air pump pressure.

According to the invention as aforementioned, the temperature of the brush of the motor that drives the electric air pump for the secondary air supply system is estimated based on the brush temperature increase rate during the motor operation. As the temperature increase rate is obtained in accordance with the discharge pressure of the pump, the brush temperature can be accurately estimated.

In the above-structured invention, the brush temperature decrease after stopping the motor operation can be obtained based on the brush temperature decrease rate. This makes it possible to accurately estimate the brush temperature even after stopping the motor operation.

In the above-structured invention, the initial brush temperature can be accurately estimated by the initial brush temperature estimation unit.

In the above-structured invention, as each of the increase and the decrease in the brush temperature can be accumulated at the respective calculation cycles, the estimation can be accurately performed.

In the above-structured invention, the brush temperature increase rate is corrected to become small as the difference between the brush temperature and the atmospheric temperature becomes large. The brush temperature decrease rate is corrected to become large as the difference between the brush temperature and the atmospheric temperature becomes large.

In the above-structured invention, as the brush temperature increase rate is corrected based on the air pump shut-off pressure, the condition of the air pump reflects the estimation so as to be accurately performed.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS

Figure 1:
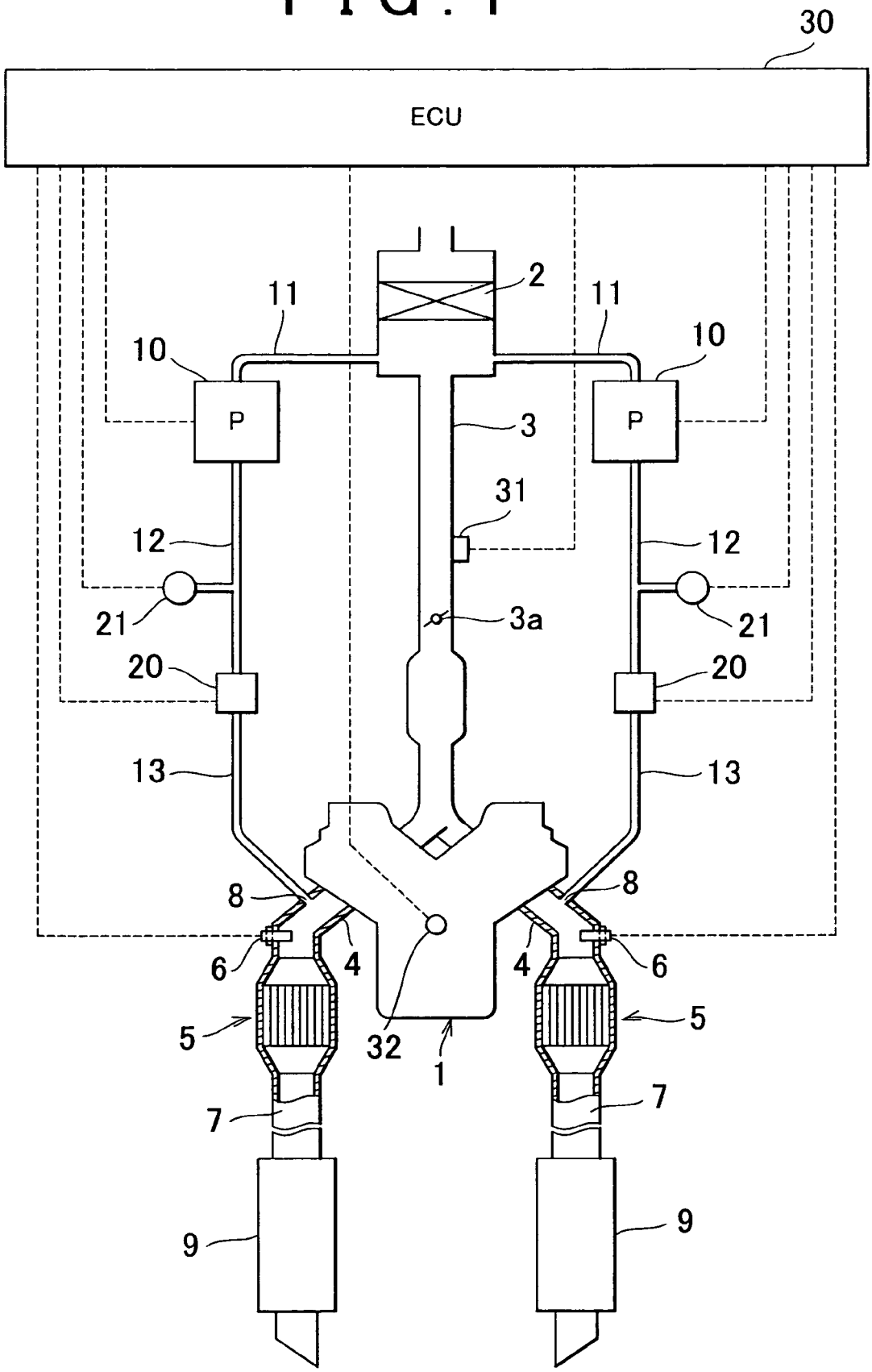
FIG. 1 is a structure of an internal combustion engine provided with an electric air pump for a secondary air supply system according to an embodiment of the invention.

Preferred embodiments of the invention will be described referring to the drawings.

Referring to FIG. 1, the common structure of the embodiments will be described. An engine 1 for a vehicle is of V-type including two banks. An intake pipe 3 is connected to the engine 1, and an inlet of the intake pipe 3 is provided with an air cleaner 2, downstream of which is provided with a throttle valve 3*a*.

The intake pipe 3 is provided with an intake air temperature sensor 31 that detects a temperature of the intake air. The engine 1 is provided with a coolant temperature sensor 32 that detects a coolant temperature.

Each cylinder of left bank and right bank of the engine 1 is connected to an exhaust pipe 7 via an intake manifold 4, respectively. A catalytic converter 5 using a three-way catalyst is provided in the exhaust pipe 7 so as to purify components contained in the exhaust gas, that is, HC, CO, and $NO_x$. An $O_2$ sensor 6 that detects an oxygen concentration of the exhaust gas is provided in the exhaust pipe 7 upstream of the catalytic converter 5. The exhaust gas that is purified through the catalytic converter 5 passes through the muffler 9 so as to be discharged.

An air pump 10 is driven by an electric motor having a brush. Each suction port (not shown) of two air pumps 10 is connected to the portion at the immediate downstream of the air cleaner 2 via an upstream air supply pipe 11. Each discharge port (not shown) of the air pumps 10 is connected to an inlet (not shown) of an air control valve 20 via an intermediate air supply pipe 12. An outlet (not shown) of the air control valve 20 is connected to the exhaust manifold 4 via a downstream air supply pipe 13.

The intermediate air supply pipe 12 is provided with a pressure sensor 21 that generates a signal corresponding to the pressure of the intermediate air supply pipe 12.

Figure 15:
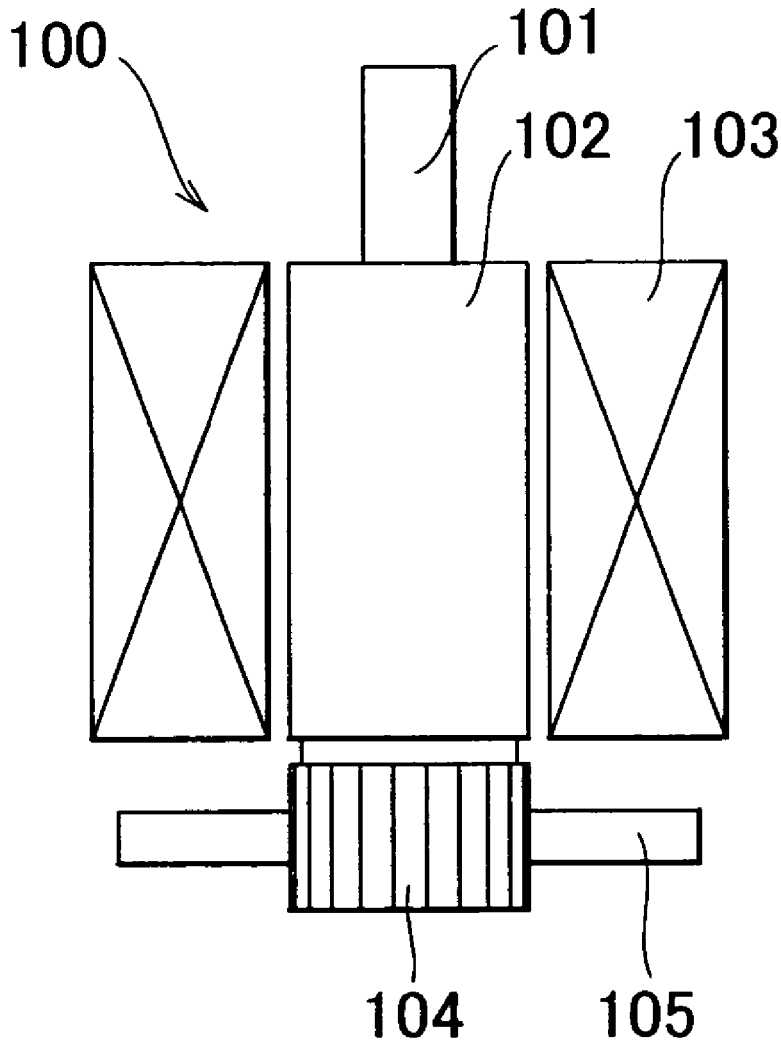
FIG. 15 is a schematic view of a motor that drives the air pump.

FIG. 15 is a schematic view of a motor 100 that drives the air pump 10. A motor shaft 101 to which the pump 10 is attached has a coil (armature) 102, and a commutator 104 attached thereto. A magnet (magnetic field) 103 is provided around the coil 102 apart therefrom. A brush 105 is provided in contact with the commutator 104.

The air pump 10, the air control valve 20 and the pressure sensor 21 are provided within an engine room (not shown) of the vehicle together with the upstream air supply pipe 11, the intermediate air supply pipe 12, and the downstream air supply pipe 13.

An ECU 30 is a microcomputer to which a ROM, a RAM, a CPU, and I/O interface (not shown) are connected via a common bus.

The ECU 30 receives inputs of signals from the pressure sensor 21, the throttle valve 3*a*, the $O_2$ sensor 6, and other sensors (not shown) employed for operation and controlling of the exhaust gas. The ECU 30 outputs control signals to the air pump 10, the air control valve 20, and other signals to other units (not shown).

In a predetermined operating condition, for example, immediately after an engine starting operation, the air pump 10 is turned ON or OFF, and the air control valve 20 is opened or closed in predetermined orders. As the explanation of the aforementioned operations is not an essential point of the invention, the detailed explanation will be omitted.

The control executed in the above-structured invention will be described.

Figure 2:
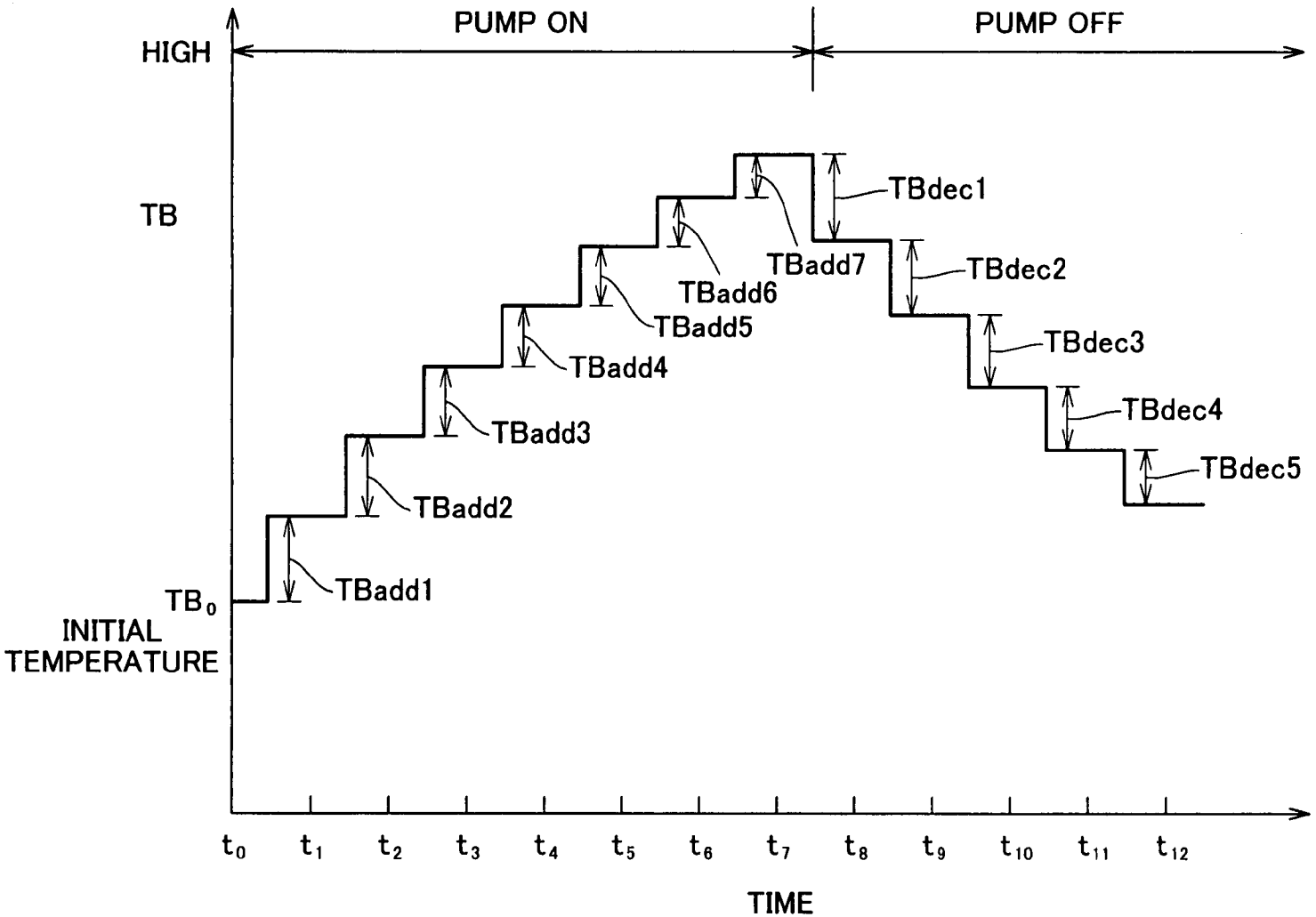
FIG. 2 is a view representing a concept of a first embodiment of the invention.

A first embodiment will be explained referring to FIG. 2 representing the concept thereof.

In FIG. 2, the air pump 10 is turned ON at time t0, and at time t7, the air pump 10 is turned OFF. The temperature of the brush is then detected at time t12.

Assuming that the brush temperature is TB, the initial temperature is TBo, the increase in the brush temperature is TBaddi at a predetermined time interval (calculation cycle), and the decrease in the brush temperature is TBdeci at a predetermined time interval (calculation cycle), the following equation is established:

$$TB=TBo+(TBadd1+\ldots+TBadd7)-(TBdec1+\ldots+TBdec5).$$

In the aforementioned case, the increase in the brush temperature is TBaddi, and the decrease in the brush temperature is TBdeci. The increase in the brush temperature (decrease in the brush temperature) is obtained by multiplying the brush temperature increase rate (brush temperature decrease rate) by a predetermined time. In this embodiment, the brush temperature increase rate (brush temperature decrease rate) is set as the value per a predetermined time, not per unit of time. Accordingly the increase in the brush temperature may be considered as being equivalent to the brush temperature increase rate, and the decrease in the brush temperature may be considered as being equivalent to the brush temperature decrease rate.

Figure 3:
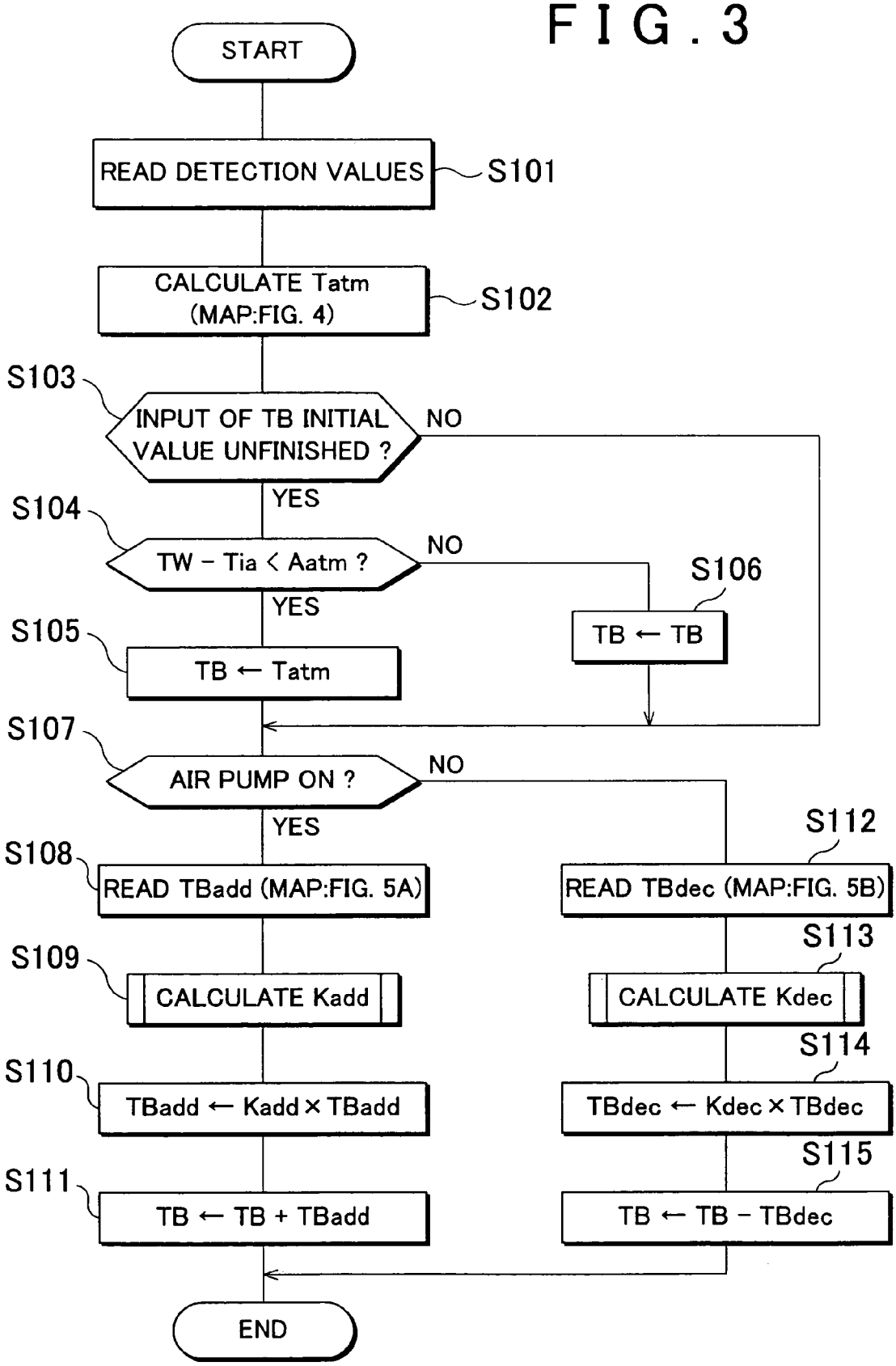
FIG. 3 is a flowchart of a control routine executed in the first embodiment.

The control routine of the embodiment will be described referring to the flowchart of FIG. 3.

Figure 4:
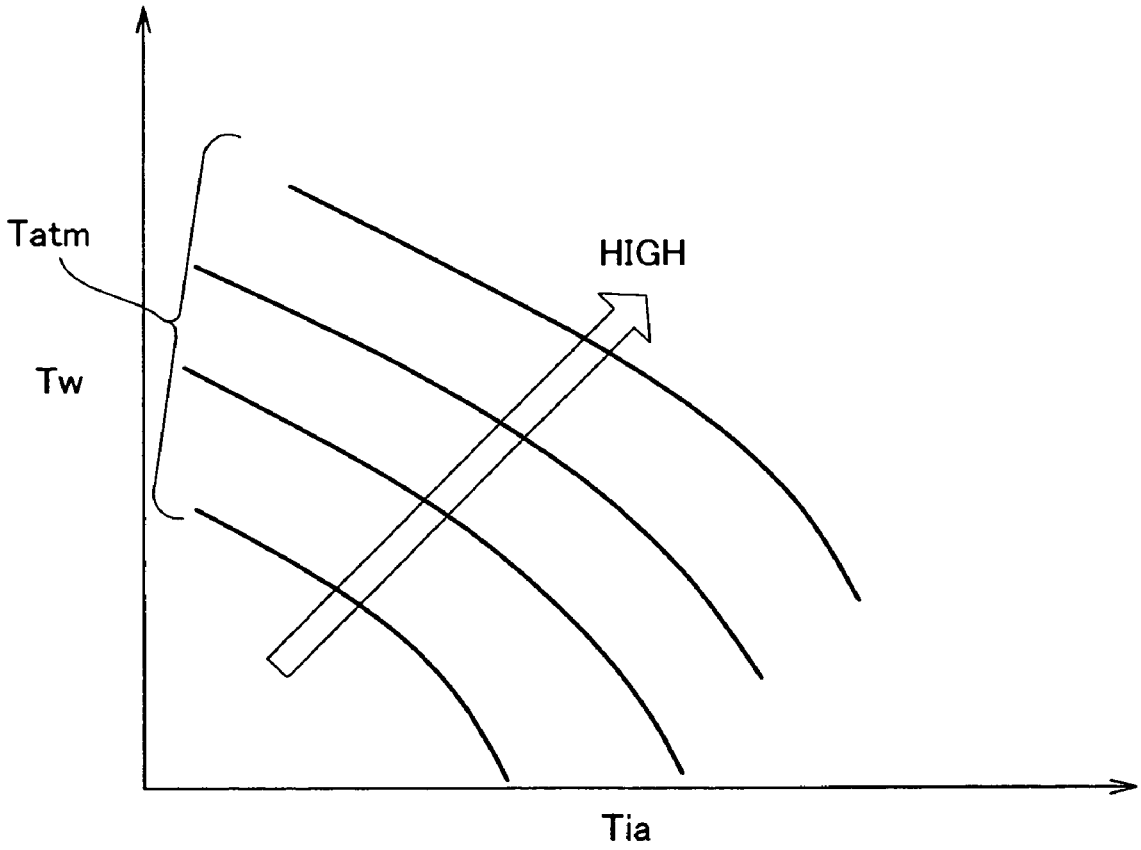
FIG. 4 is a map representing a correlation among an intake air temperature Tia, a coolant temperature Tw, and an atmospheric temperature Tatm.

In step S 101, a discharge pressure P of the air pump 10, a coolant temperature Tw, an intake air temperature Tia and the like are read. In step S102, an atmospheric temperature Tatm of the brush is calculated from a map shown in FIG. 4 based on the coolant temperature Tw and the intake air temperature Tia.

In step S103, it is determined whether an input of an initial value of the brush temperature TB has been unfinished. If YES is obtained in step S103, that is, the input of the initial value has been unfinished, the process proceeds to step S104. Meanwhile if NO is obtained in step S103, that is, the input of the initial value has been finished, the process proceeds to step S107.

In step S104, it is determined whether the difference between the coolant temperature Tw and the intake air temperature Tia is smaller than a predetermined reference value Aatm. If the engine has been in the stopped state for an elongated period of time, the difference between the coolant temperature Tw and the intake air temperature Tia becomes small, and accordingly the brush of the air pump 10 is sufficiently cooled. Then the brush temperature TB becomes substantially equal to the atmospheric temperature Tatm. In the case where the difference between the coolant temperature and the intake air temperature is lower than the reference value that has been appropriately set, it is possible to estimate that the brush has been sufficiently cooled and accordingly, the brush temperature TB is equal to the atmospheric temperature Tatm. If YES is obtained in step S104, the process proceeds to step S105 where the atmospheric temperature Tatm is set to the brush temperature TB. This is represented by the initial temperature TBo in FIG. 2. Subsequent to execution of step S105, the process proceeds to step S107.

If NO is obtained in step S104, it may be estimated that the engine 1 has been temporarily stopped and immediately resumed thereafter. In such a case, the process proceeds to step S106 where the last value obtained in the estimation of the brush temperature TB in the previous cycle is set as the initial value, and the process further proceeds to step S107.

In step S107, it is determined whether the air pump 10 has been turned ON. If YES is obtained in step S107, that is, the air pump 10 has been turned ON, the process in steps S108 to S1 is executed. If NO is obtained in step S107, that is, the air pump 10 has been turned OFF, the process in steps S112 to S115 is executed.

Figure 5:
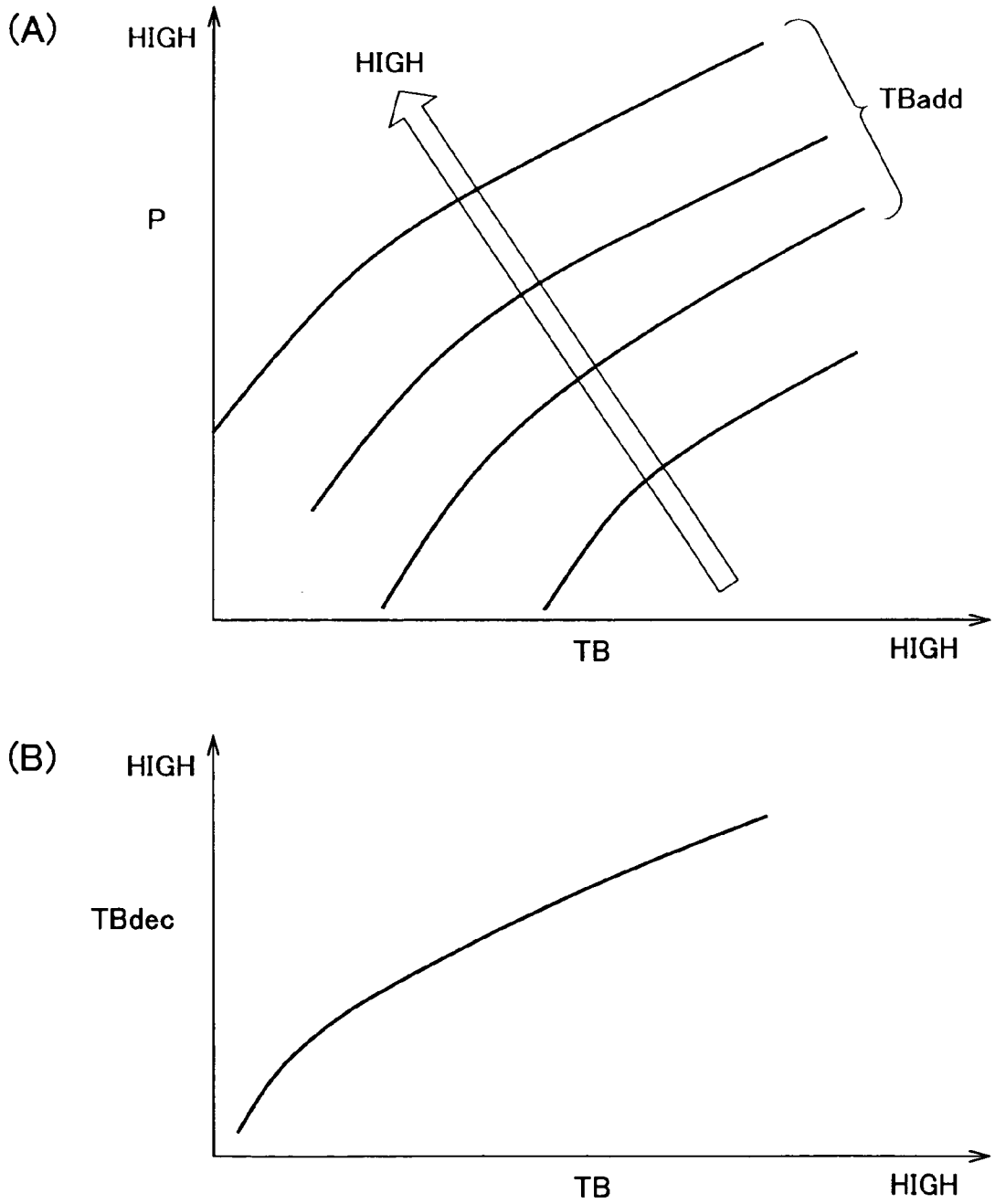
FIG. 5A is a map representing a correlation among a discharge pressure P of the air pump, a brush temperature TB, and a brush temperature increase rate TBadd.
FIG. 5B is a map representing a relationship between the brush temperature TB and a brush temperature decrease rate TBdec.

If the process proceeds to step S108, the discharge pressure P of the air pump 10 and the brush temperature increase rate TBadd corresponding to the brush temperature TB are read from the map shown in FIG. 5A, and the process proceeds to step S109. If the process proceeds to step S112, the brush temperature decrease rate TBdec corresponding to the brush temperature TB of the air pump 10 is read from the map shown in FIG. 5B, and the process proceeds to step S113.

In step S109, a brush temperature increase rate correction factor Kadd is calculated for correcting the brush temperature increase rate TBadd in accordance with the current condition. Meanwhile in step S113, a brush temperature decrease rate correction factor Kdec is calculated for correcting the brush temperature decrease rate TBdec in accordance with the current condition. The detailed explanation with respect to the calculation of those brush temperature increase rate correction factor Kadd and the brush temperature decrease rate correction factor Kdec will be described later.

In step S110, the brush temperature increase rate TBadd is multiplied by the brush temperature increase rate correction factor Kadd calculated in step S109 so as to be corrected. Meanwhile in step S114, the brush temperature decrease rate TBdec is multiplied by the brush temperature decrease rate correction factor Kdec calculated in step S113 so as to be corrected.

In step S111, the brush temperature increase rate TBadd that has been corrected in step S110 is added to the brush temperature TB in step S105 or S106 in case of the first calculation. It is added to the brush temperature TB upon completion of the previous calculation routine in case of the calculation other than the first one. Then the present routine ends.

In step S115, in case of the first calculation, the brush temperature decrease rate TBdec that has been corrected in step S114 is subtracted from the brush temperature TB in step S105 or S106 to set the brush temperature TB in the present routine. In case of the calculation other than the first one, the brush temperature decrease rate TBdec is subtracted from the brush temperature TB upon completion of the previous calculation routine. Then the present routine ends.

The brush temperature increase rate correction factor Kadd calculated in step S109, and the brush temperature decrease rate correction factor Kdec calculated in step S113 will be described hereinafter.

Figure 6:
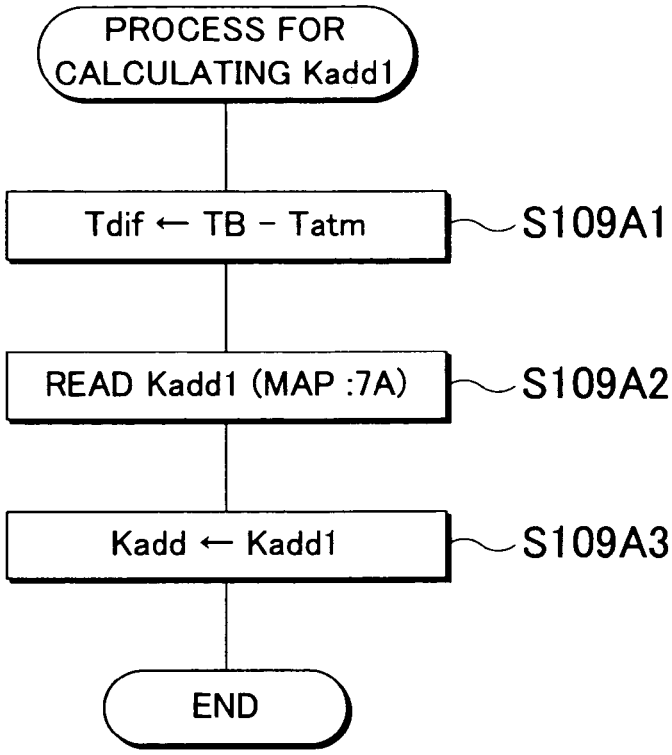
FIG. 6A is a sub-routine of a first process that calculates a correction factor Kadd of the brush temperature increase rate TBadd.
FIG. 6B is a sub-routine of a first process that calculates a correction factor Kdec of the brush temperature decrease rate TBdec.
Figure 6:
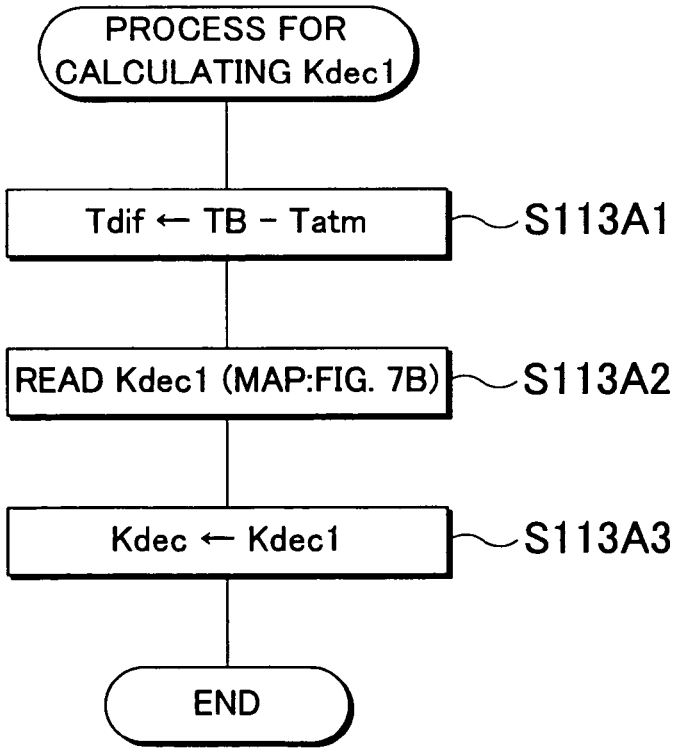
Figure 7:
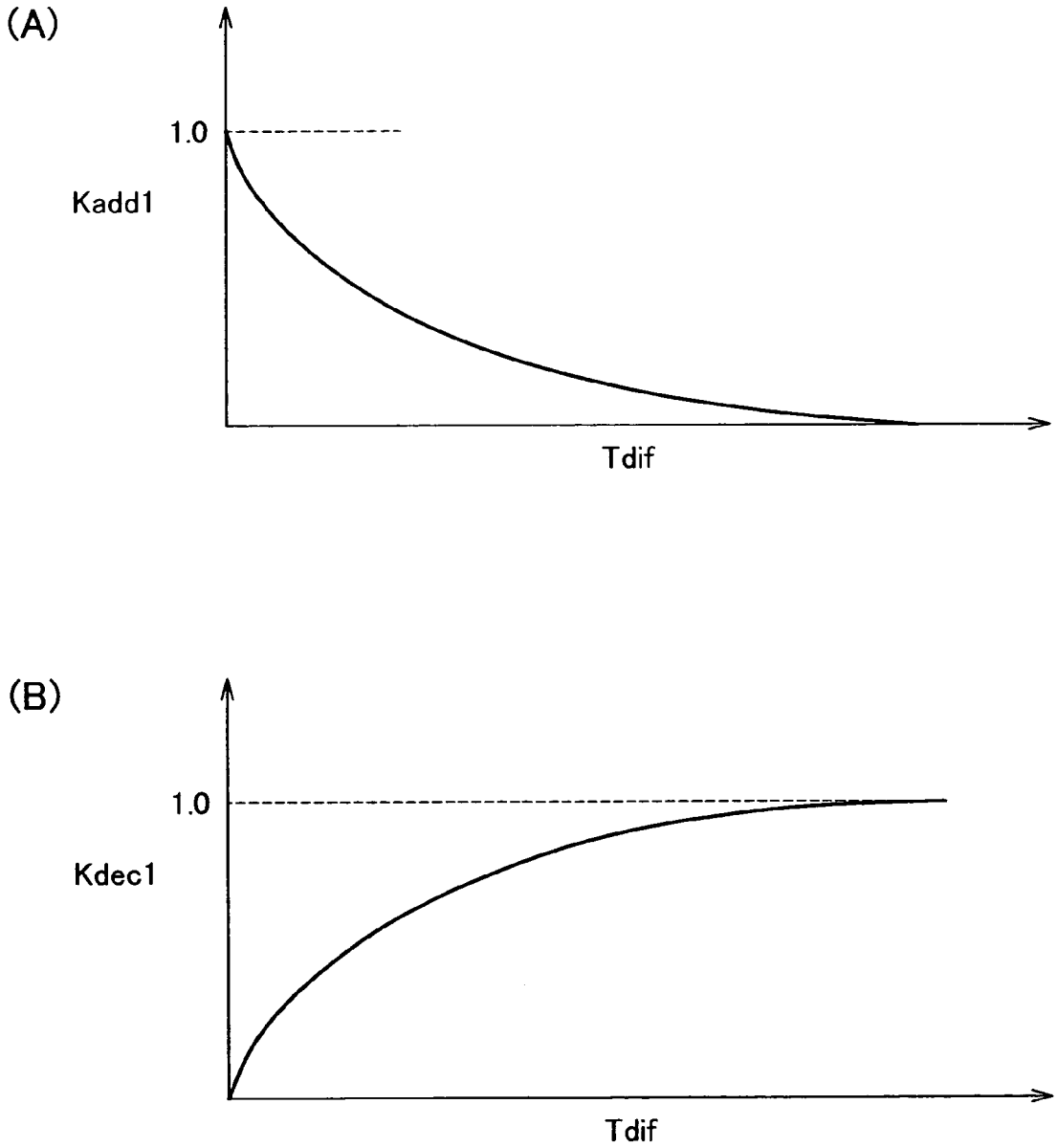
FIG. 7A is a map representing a relationship between a difference in the temperature Tdif between the brush temperature TB and the atmospheric temperature Tatm, and a correction factor Kadd1 of the brush temperature increase rate TBadd, which has been obtained in the first process of the sub-routine of FIG. 6A.
FIG. 7B is a map representing a relationship between a difference in the temperature Tdif between the brush temperature TB and the atmospheric temperature Tatm, and the correction factor Kdec1 of the brush temperature decrease rate TBdec, which has been obtained in the first process of the sub-routine of FIG. 6B.

The sub-routine of the first process that calculates the brush temperature increase rate correction factor Kadd is shown in FIG. 6A. In step S109A1, the atmospheric temperature Tatm is subtracted from the brush temperature TB so as to obtain the temperature difference Tdif between the TB and Tatm. In step S109A2, a brush temperature increase rate correction factor Kadd1 corresponding to the temperature difference Tdif that has been calculated from the map in FIG. 7A is read. In step S109A3, the brush temperature increase rate correction factor Kadd1 that has been read in step S109A2 is set to the brush temperature increase rate correction factor Kadd. The sub-routine then ends.

Referring to FIG. 5A, the brush temperature increase rate TBadd is set to become small as the brush temperature TB becomes high. It becomes small as the difference between the atmospheric temperature Tatm and the brush temperature becomes large. In FIG. 7A, the brush temperature increase rate correction factor Kadd1 is set to become small as the temperature difference Tdif becomes large.

FIG. 6B shows the sub-routine of the first process that calculates the brush temperature decrease rate correction factor Kdec. In step S113A1, the atmospheric temperature Tatm is subtracted from the brush temperature TB so as to obtain the temperature difference Tdif between the TB and the Tatm. In step S113A2, the brush temperature decrease rate correction factor Kdec1 corresponding to the temperature difference Tdif calculated from the map shown in FIG. 7B is read. In step S13A3, the brush temperature decrease rate correction factor Kdec1 that has been read in step S113A2 is set to the brush temperature decrease rate correction factor Kdec. The sub-routine then ends.

As shown in FIG. 5B, the brush temperature decrease rate TBdec is set to become large as the brush temperature TB becomes high. It becomes large as the difference between the atmospheric temperature Tatm and the brush temperature TB becomes large. As shown in FIG. 7B, the brush temperature decrease rate correction factor Kdec1 is set to become large as the temperature difference Tdif becomes large.

Figure 8:
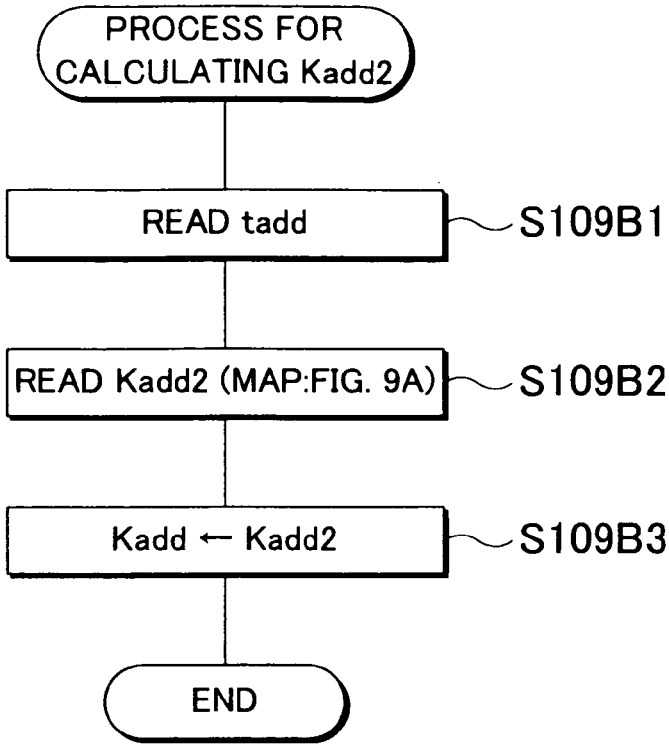
FIG. 8A is a sub-routine of a second process that calculates a correction factor Kadd of the brush temperature increase rate TBadd.
FIG. 8B is a sub-routine of a second process that calculates a correction factor Kdec of the brush temperature decrease rate TBdec.
Figure 8:
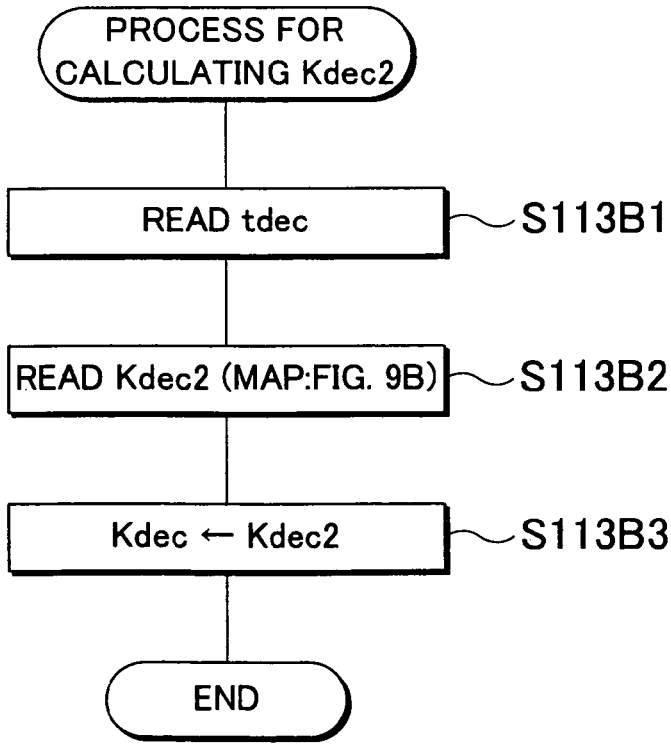

FIG. 8A represents a sub-routine of the second process that calculates the brush temperature increase rate correction factor Kadd. In step S109B1, the time tadd elapsing from the starting operation of the air pump 10 is detected and read. In step S109B2, the brush temperature increase rate correction factor Kadd2 corresponding to the elapsed time tadd is read from the map of FIG. 9A. In step S109B3, the brush temperature increase rate correction factor Kadd2 that has been read in step S109B is set to the brush temperature increase rate correction factor Kadd. The sub-routine then ends.

Figure 9:
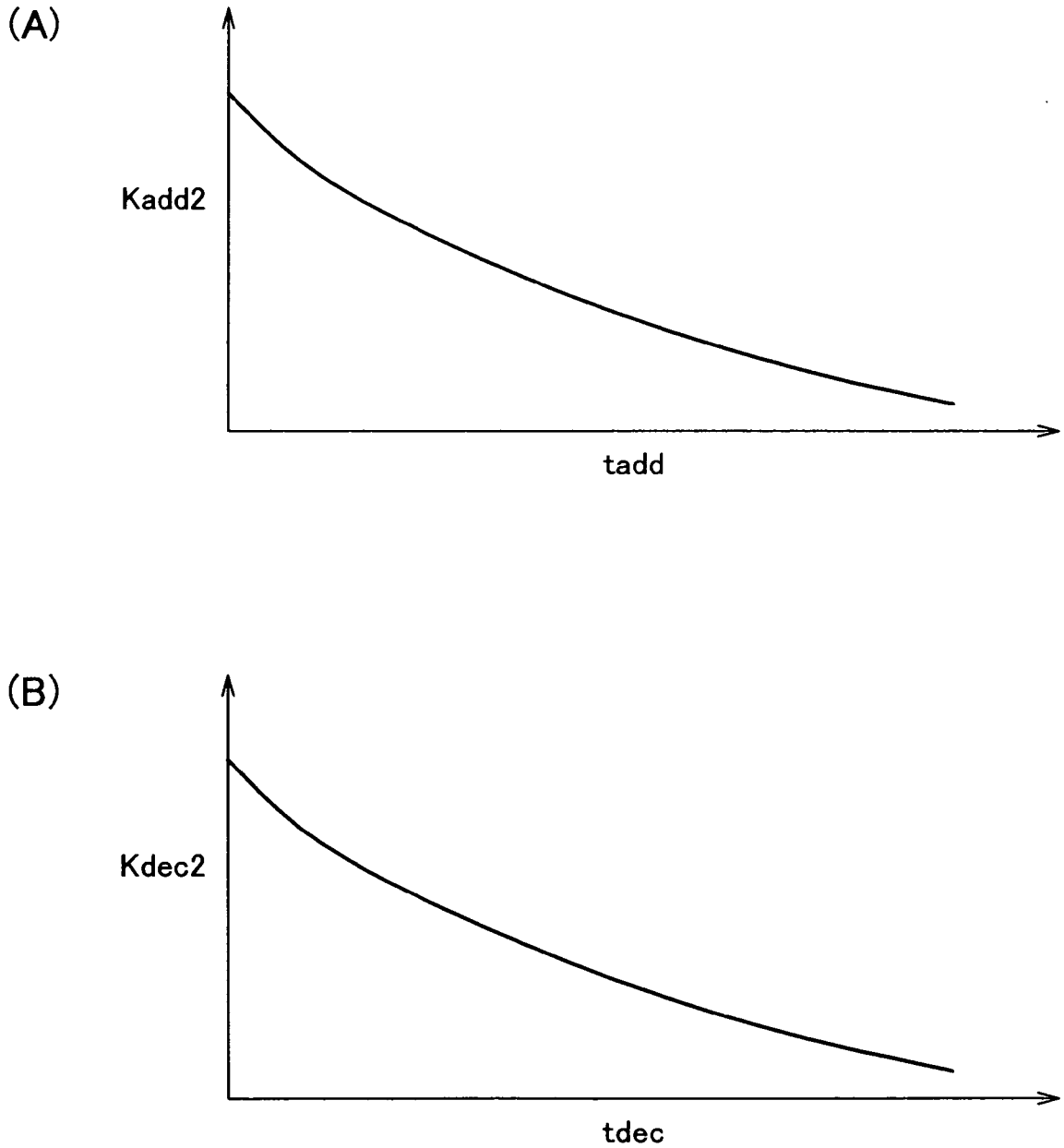
FIG. 9A is a map representing a relationship between a time tadd elapsing from a starting operation of the air pump and a correction factor Kadd2 of the brush temperature increase rate TBadd, which has been obtained in the second process of the sub-routine in FIG. 8A.
FIG. 9B is a map representing a relationship between a time tdec elapsing from stopping the air pump operation and a correction factor Kdec2 of the brush temperature decrease rate TBdec, which has been obtained in the second process of the sub-routine in FIG. 8B.

Referring to FIG. 5A, the brush temperature increase rate TBadd is set to be small as the brush temperature TB becomes high. It becomes small as the difference between the brush temperature TB and the atmospheric temperature Tatm becomes large. As the time tadd elapsing from the starting operation of the air pump 10 becomes long, the difference between the brush temperature TB and the atmospheric temperature Tatm becomes large. As shown in FIG. 9A, as the time tadd elapsing from the starting operation of the air pump 10 becomes long, the brush temperature increase rate correction factor Kadd2 becomes small.

FIG. 8B shows a sub-routine of a second process that calculates the brush temperature decrease rate correction factor Kdec. In step S113B1, the time tdec elapsing from stopping the operation of the air pump 10 is detected and read. In step S113B2, the brush temperature decrease rate correction factor Kdec2 corresponding to the elapsed time tdec is read from the map shown in FIG. 9B. In step S113B3, the brush temperature decrease rate correction factor Kdec2 that has been read in step S113B2 is set to the brush temperature decrease rate correction factor Kdec. The sub-routine then ends.

As shown in FIG. 5B, the brush temperature decrease rate TBdec is set to become small as the brush temperature TB becomes low. It becomes small as the temperature difference between the brush temperature TB and the atmospheric temperature Tatm becomes small. The longer the time tdec elapsing from stopping the operation of the air pump 10 becomes, the smaller the difference between the brush temperature TB and the atmospheric temperature Tatm becomes. As shown in FIG. 9B, the brush temperature decrease rate correction factor Kdec2 is set to become small as the time tdec elapsing from stopping the operation of the air pump 10 becomes long.

Figure 10:
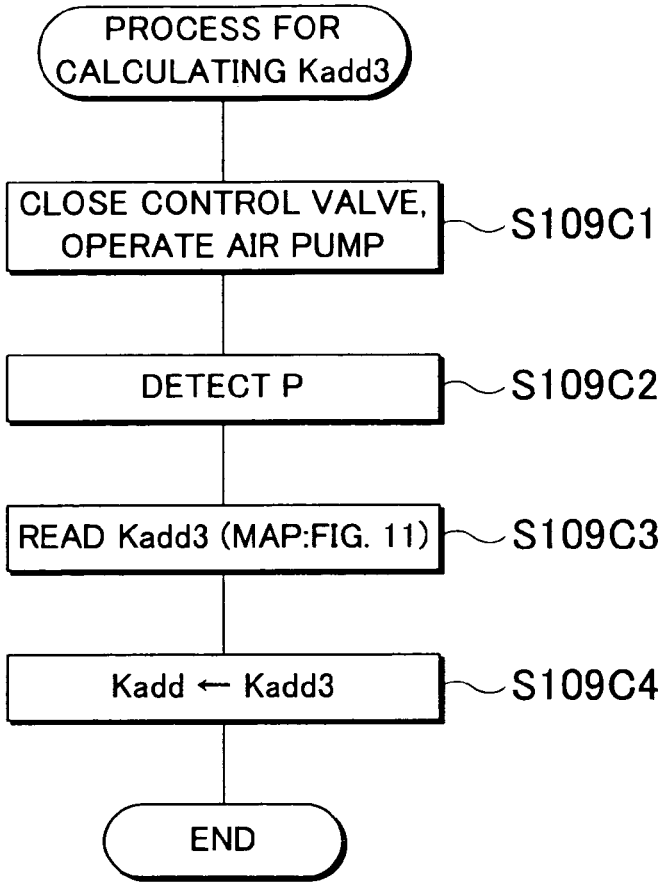
FIG. 10 is a sub-routine of a third process that calculates a correction factor Kadd of the brush temperature increase rate TBadd.

FIG. 10 shows a sub-routine of the third process that calculates the brush temperature increase rate correction factor Kadd.

This process is executed to cope with the decrease in the output of the air pump 10 owing to, for example, abrasion and the like. Upon decrease in the output of the air pump 10, its discharge pressure P is reduced as well as its heat generation amount. If the discharge pressure P of the air pump 10 is decreased, the correction is performed to reduce the brush temperature increase rate TBadd with the brush temperature increase rate correction factor Kadd calculated in the third process.

Figure 11:
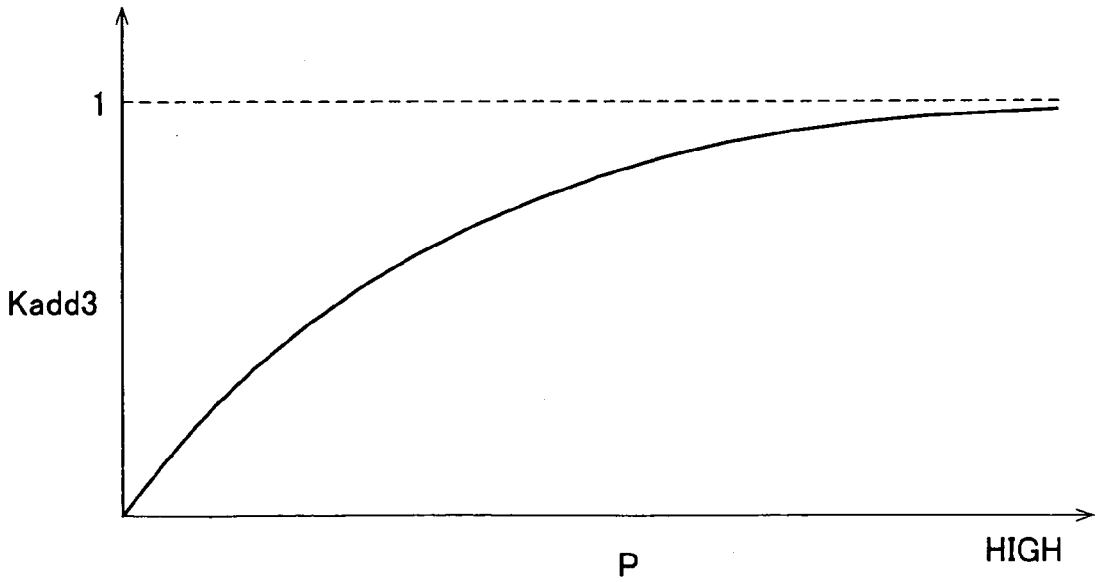
FIG. 11 is a map representing a relationship between a discharge pressure P of the air pump and a correction factor Kadd3 of the brush temperature increase rate TBadd, which has been obtained in the third process of the sub-routine in FIG. 10.

Referring to the flowchart of FIG. 10, in step S109C1, the control valve 20 is closed and the air pump 10 is operated. Then in step S109C2, the discharge pressure P of the air pump 10 is detected and read. In step S109C3, the brush temperature increase rate correction factor Kadd3 corresponding to the discharge pressure P is obtained from the map shown in FIG. 11. In step S109C4, the value Kadd3 is input as the Kadd. The routine then ends.

The correction with the sub-routine of the third process may be performed together with the sub-routine of the first or the second process.

Figure 12:
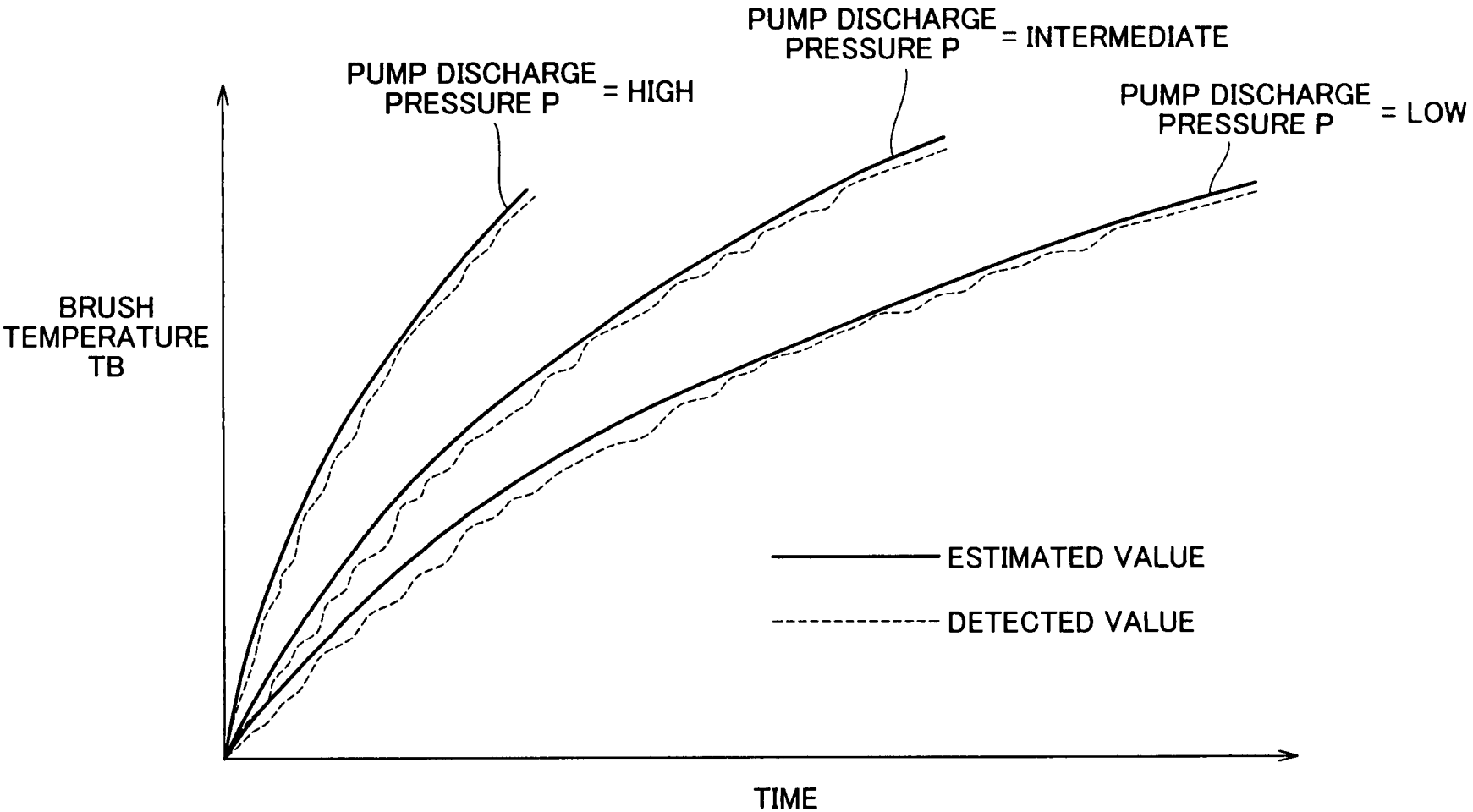
FIG. 12 shows a view of estimated values and detected values of the brush temperature TB according to the first embodiment.

FIG. 12 shows a graph representing a comparison between estimated values and detected values of the brush temperature TB during operation of the air pump 10 in the first embodiment as aforementioned. As shown in the graph, the estimated values well accord with the detected values.

Figure 13:
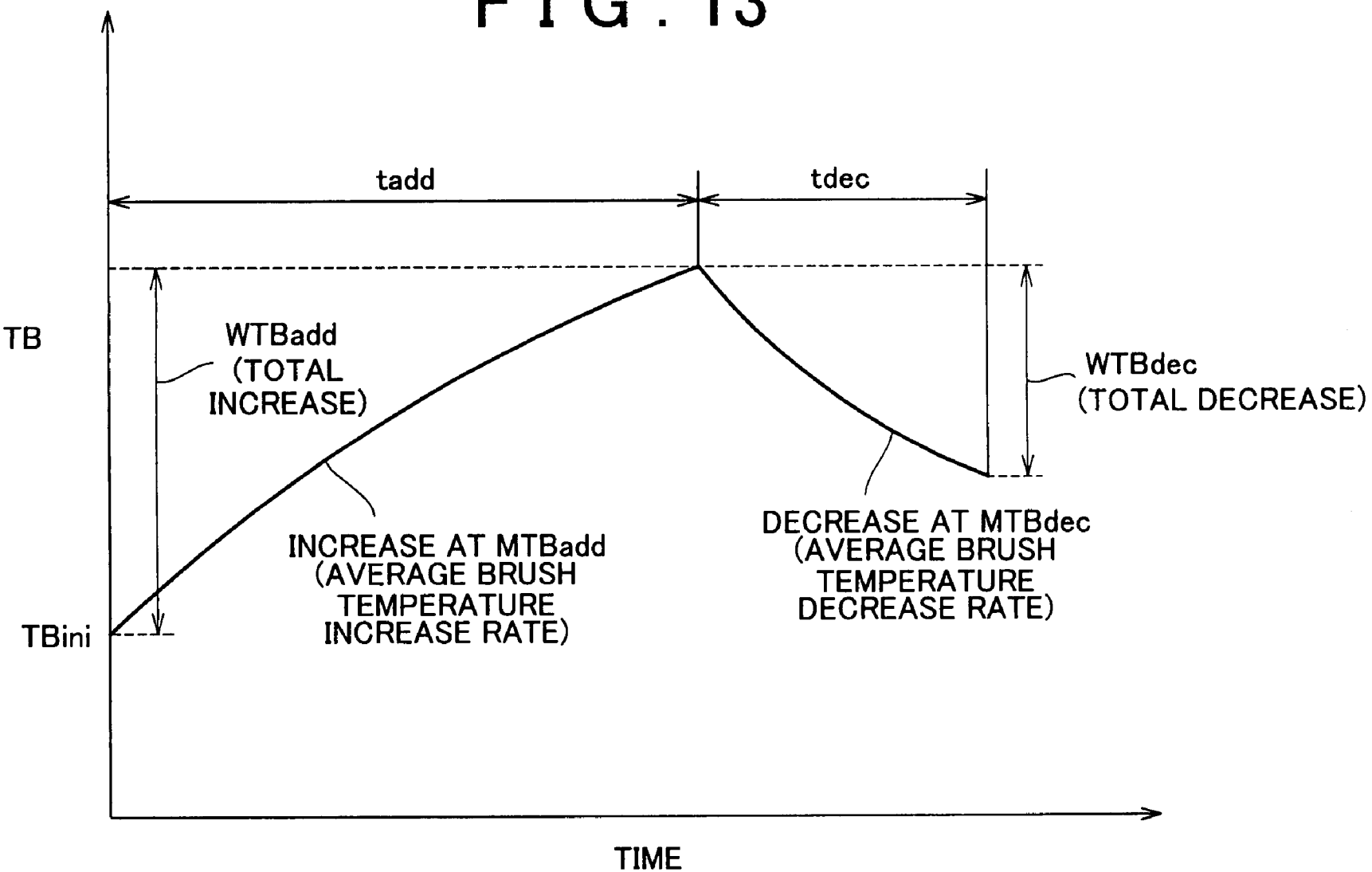
FIG. 13 is a view representing a concept of a second embodiment of the invention.

A second embodiment of the invention will be described hereinafter. In the second embodiment, a total temperature increase WTBadd in the brush temperature TB during the operation of the air pump 10 is obtained by multiplying an average brush temperature increase rate MTBadd per unit of time by the time tadd elapsing from the starting operation of the air pump 10. Meanwhile a total temperature decrease WTBdec in the brush temperature TB is obtained by multiplying an average brush temperature decrease rate MTBdec per unit of time by the time tdec elapsing from stopping the operation of the air pump 10. Each of the thus obtained values is added to and subtracted from the initial value of the brush temperature TB so as to obtain the brush temperature TB. FIG. 13 is the view that represents the concept of the second embodiment of the invention.

Figure 14:
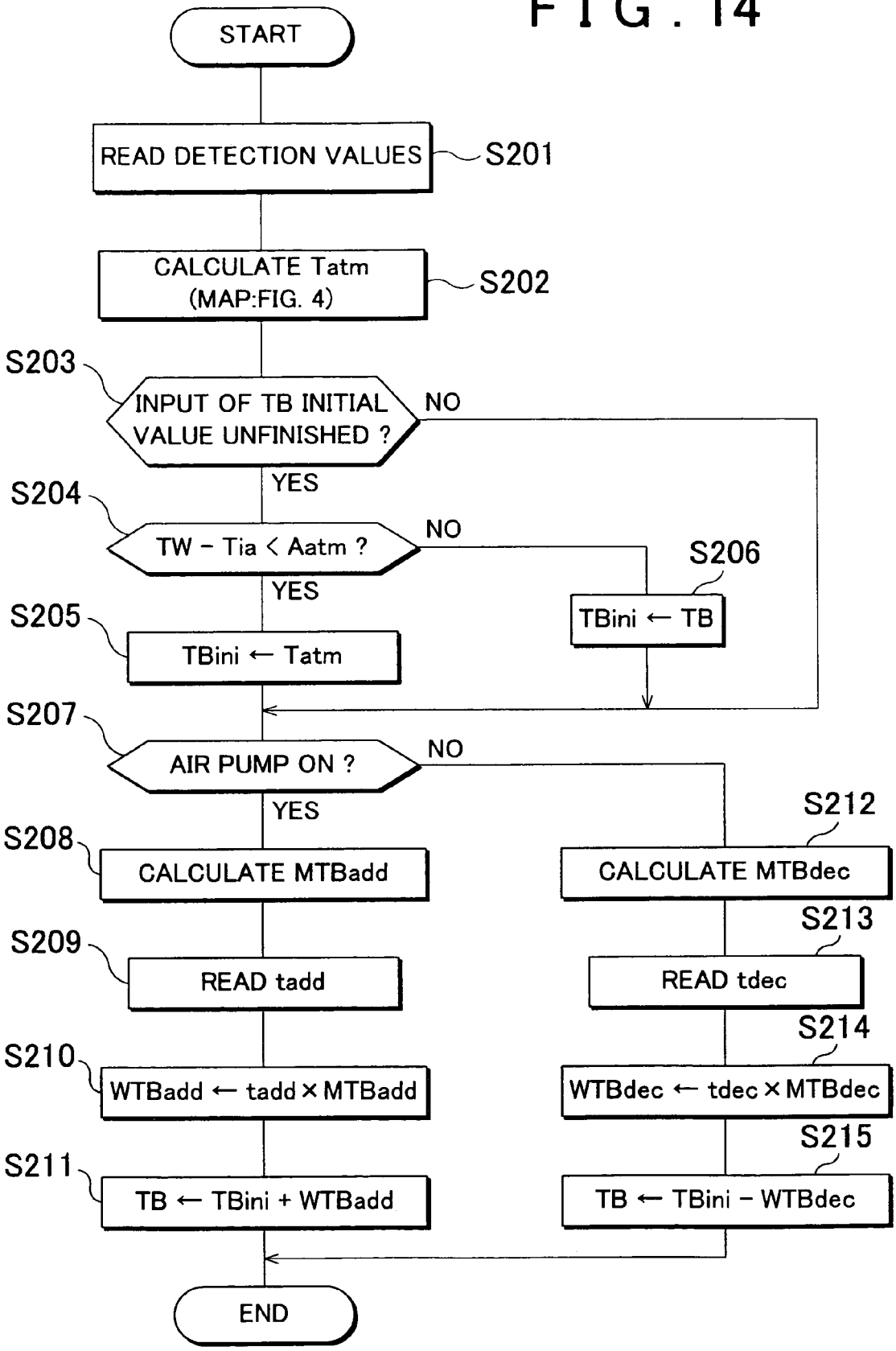
FIG. 14 is a flowchart of a control routine executed in the second embodiment.

FIG. 14 is a flowchart of the control routine executed in the second embodiment.

The process executed in steps S201 to S204, and step S207 are the same as that executed in steps S101 to S104, and step S107 in the first embodiment. The process in steps S205 and S206 of the second embodiment is different from the process executed in steps of the first embodiment in that the atmospheric temperature Tatm, and a previous brush temperature TB are input to the initial value TBini, which is not updated in the course of the calculation routine.

In step S208, the average brush temperature increase rate MTBadd is calculated. It may be obtained by averaging the brush temperature increase rate Tbadd from map shown FIG. 5A at respective calculation cycles with the appropriate process. Alternatively each average value of the discharge pressure P of the air pump 10 and the brush temperature TB is obtained in the respective calculation cycles. Then the brush temperature increase rate TBadd corresponding to the respective average values may be obtained from the map of FIG. 5A.

In step S212, the average brush temperature decrease rate MTBdec is calculated. Likewise it may be obtained by averaging the brush temperature decrease rates TBdec from the map shown in FIG. 5B at the respective calculation cycles with the appropriate process. Alternatively, each average value of the discharge pressure P of the air pump 10 and the brush temperature TB is obtained in the respective calculation cycles. Then the brush temperature increase rate TBadd corresponding to the respective average values may be obtained from the map of FIG. 5B.

In step S209, the time tadd elapsing from the starting operation of the air pump 10 is read, and in step S213, the time tdec elapsing from stopping the operation of the air pump 10 is read.

In step S210, the total temperature increase WTB add during the operation of the air pump 10 is obtained by multiplying the average brush temperature increase rate MTBadd per unit of time by the time tadd elapsing from the starting operation of the air pump 10. In step S214, the total temperature decrease WTBdec during the operation of the air pump 10 is obtained by multiplying the average brush temperature decrease rate MTBdec per unit of time by the time tdec elapsing from stopping the operation of the air pump 10.

In step S211, the total temperature increase WTBadd is added to the brush temperature initial value TBini so as to obtain the brush temperature TB. In step S215, the total temperature decrease WTBdec is subtracted from the brush temperature initial value TBini so as to obtain the brush temperature TB.

In the second embodiment, the brush temperature TB is obtained as aforementioned. The accuracy of the resultant value is not so accurate as that obtained in the first embodiment. However, the calculation load is lower than that of the first embodiment.

The average brush temperature increase rate MTBadd and the average brush temperature decrease rate MTBdec obtained in steps S208 and S212 may be corrected with the correction factors Kadd and Kdec, respectively as in steps S109 and S113 of the routine in the first embodiment.

As has been explained with respect to the first and the second embodiments of the invention, the brush temperature TB is estimated, based on which the operation of the air pump 10 is controlled, for example, it may be stopped if the brush temperature TB exceeds the allowable value.

The invention is applicable to the electric air pump driven by the motor with brush. It is to be understood that the invention may be applied to the other type of device with the similar structure, operation and the use.

What is claimed is:

1. An electric air pump that is driven by a motor with a brush and employed for a secondary air supply system, comprising:

a brush temperature change rate storage unit that stores a brush temperature change rate including a brush temperature increase rate stored in accordance with a discharge pressure of the electric air pump; and a brush temperature estimation unit that estimates a temperature of the brush based on the brush temperature change rate stored in the brush temperature change rate storage unit, wherein when the motor is in an operating state, the brush temperature estimation unit estimates a temperature of the brush based on the brush temperature increase rate.

2. The electric air pump according to claim 1, wherein the brush temperature change rate stored in the brush temperature change rate storage unit further comprises a brush temperature decrease rate after a stopping operation of the motor.

3. The electric air pump according to claim 2, wherein the brush temperature estimation unit comprises an initial brush temperature estimation unit that estimates an initial brush temperature.

4. The electric air pump according to claim 3, wherein the brush temperature estimation unit estimates the temperature of the brush by executing at least one of adding a value obtained by multiplying the brush temperature increase rate by a length of time to the initial brush temperature estimated by the initial brush temperature estimation unit, and subtracting a value obtained by multiplying the brush temperature decrease rate by a length of time from the initial brush temperature estimated by the initial brush temperature estimation unit.

5. The electric air pump according to claim 4, wherein the length of time multiplied by one of the brush temperature increase rate and the brush temperature decrease rate is a calculation cycle, and the addition and the subtraction are cumulatively performed.

6. The electric air pump according to claim 4, wherein the length of time multiplied by the brush temperature increase rate is a time elapsing from the starting operation of the air pump, the length of time multiplied by the brush temperature decrease rate is a time elapsing from stopping the operation of the air pump, and the addition and the subtraction are cumulatively performed.

7. The electric air pump according to claim 1, wherein the brush temperature increase rate stored in the brush temperature change rate storage unit is set to become high as the discharge pressure of the air pump becomes high.

8. The electric air pump according to claim 2, further comprising at least one of a brush temperature increase rate correction unit that corrects the brush temperature increase rate to become small as a difference between the brush temperature and an atmospheric temperature becomes large, and a brush temperature decrease rate correction unit that corrects the brush temperature decrease rate to become large as the difference between the brush temperature and the atmospheric temperature becomes large.

9. The electric air pump according to claim 8, wherein the brush temperature increase rate correction unit decreases the brush temperature increase rate as the time elapsing from the starting operation of the motor becomes long, and the brush temperature decrease rate correction unit decreases the brush temperature decrease rate as the time elapsing from stopping the motor operation becomes long.

10. The electric air pump according to claim 8, further comprising an atmospheric temperature estimation unit that estimates the atmospheric temperature of the brush, wherein at least one of the brush temperature increase rate and the brush temperature decrease rate is corrected based on the atmospheric temperature estimated by the atmospheric temperature estimation unit.

11. The electric air pump according to claim 3, further comprising an atmospheric temperature estimation unit that estimates the atmospheric temperature of the brush, wherein the initial brush temperature estimation unit estimates the brush temperature at the starting operation based on the atmospheric temperature estimated by the atmospheric temperature estimation unit.

12. The electric air pump according to claim 10, wherein the atmospheric temperature estimation unit estimates the atmospheric temperature based on an intake air temperature and a coolant temperature.

13. The electric air pump according to claim 11, wherein the atmospheric temperature estimation unit estimates the atmospheric temperature based on an intake air temperature and a coolant temperature.

14. The electric air pump according to claim 12, wherein when the difference between the intake air temperature and the coolant temperature detected by the atmospheric temperature estimation unit is equal to or smaller than a predetermined value, the atmospheric temperature is set to the initial brush temperature.

15. The electric air pump according to claim 13, wherein when the difference between the intake air temperature and the coolant temperature detected by the atmospheric temperature estimation unit is equal to or smaller than a predetermined value, the atmospheric temperature is set to the initial brush temperature.

16. The electric air pump according to claim 2, wherein a shut-off air pump pressure is detected as a discharge pressure obtained when an outlet of the air pump is shut off, and the brush temperature increase rate is corrected based on the detected shut-off air pump pressure.

* * * * *